US007621653B2

(12) United States Patent
Hendrie

(10) Patent No.: US 7,621,653 B2
(45) Date of Patent: Nov. 24, 2009

(54) MULTI-FUNCTION ILLUMINATION DEVICE

(75) Inventor: Piers Hendrie, Austin, TX (US)

(73) Assignee: Xenopus Electronix, LLC, Austin, TX (US)

( * ) Notice: Subject to any disclaimer, the term of this patent is extended or adjusted under 35 U.S.C. 154(b) by 139 days.

(21) Appl. No.: 11/603,547

(22) Filed: Nov. 22, 2006

(65) Prior Publication Data

US 2007/0153512 A1 Jul. 5, 2007

Related U.S. Application Data

(60) Provisional application No. 60/738,728, filed on Nov. 22, 2005.

(51) Int. Cl.
*F21V 9/10* (2006.01)
*H01K 7/04* (2006.01)

(52) U.S. Cl. ..... 362/231; 362/249.05; 362/249.12; 362/800; 257/89; 315/76

(58) Field of Classification Search ..... 362/55, 362/545, 231, 249.02, 249.05, 249.12, 84, 362/800; 257/89; 315/76
See application file for complete search history.

(56) References Cited

U.S. PATENT DOCUMENTS 3,789,211 A * 1/1974 Kramer ..... 362/231
4,211,955 A * 7/1980 Ray ..... 315/53
4,992,704 A * 2/1991 Stinson ..... 315/312
5,420,482 A * 5/1995 Phares ..... 315/292
5,770,116 A * 6/1998 Byrne, Jr. ..... 252/700
6,016,038 A * 1/2000 Mueller et al. ..... 315/291
6,608,453 B2 * 8/2003 Morgan et al. ..... 315/312
6,801,003 B2 * 10/2004 Schanberger et al. ..... 315/291
6,933,680 B2 * 8/2005 Oskorep et al. ..... 315/178
7,015,825 B2 * 3/2006 Callahan ..... 340/815.45
7,290,896 B2 * 11/2007 Dallas et al. ..... 362/184
2002/0145869 A1 * 10/2002 Dowling ..... 362/192
2002/0152045 A1 * 10/2002 Dowling et al. ..... 702/107
2004/0066652 A1 * 4/2004 Hong ..... 362/234

* cited by examiner

*Primary Examiner*—Ismael Negron
(74) *Attorney, Agent, or Firm*—Winstead PC

(57) ABSTRACT

A multi-function illumination device including a light emitting diode (LED) module. The light emitting diode (LED) module includes a control circuit having a first control output and a second control output. A first light emitting diode (LED) bank is coupled to the first control output. The first LED bank includes at least one first light emitting diode (LED) for emitting light of a first wavelength. The light emitting diode (LED) module a second light emitting diode (LED) bank coupled to the second control output. The second LED bank includes at least one second light emitting diode (LED) for emitting light of a second wavelength. During a first mode of operation, the control circuit is adapted to cause the first LED bank to illuminate continuously and the second LED bank to flash on and off at a predetermined frequency.

29 Claims, 6 Drawing Sheets

MULTI-FUNCTION ILLUMINATION DEVICE

CROSS-REFERENCE TO RELATED APPLICATIONS

This application claims the benefit of and incorporates by reference the entire disclosure of U.S. Provisional Patent Application No. 60/738,728, filed on Nov. 22, 2005.

BACKGROUND

LED flashlights have many advantages over flashlights that use conventional light bulbs, including lower power consumption (i.e., longer battery life), better wavelength matching (i.e., less dispersion), and other benefits. Typical LED flashlights, however, like their conventional-bulb counterparts, usually have only one function, namely, to provide a constant beam of light.

SUMMARY OF THE INVENTION

A multi-function illumination device including a light emitting diode (LED) module. The light emitting diode (LED) module includes a control circuit having a first control output and a second control output. A first light emitting diode (LED) bank is coupled to the first control output. The first LED bank includes at least one first light emitting diode (LED) for emitting light of a first wavelength. The light emitting diode (LED) module a second light emitting diode (LED) bank coupled to the second control output. The second LED bank includes at least one second light emitting diode (LED) for emitting light of a second wavelength. During a first mode of operation, the control circuit is adapted to cause the first LED bank to illuminate continuously and the second LED bank to flash on and off at a predetermined frequency. A multi-function illumination device includes a light emitting diode (LED) module. The light emitting diode (LED) module includes a control circuit having a first control output and a second control output. The light emitting diode (LED) module further includes a first light emitting diode (LED) bank coupled to the first control output. The first LED bank includes at least one first light emitting diode (LED) for emitting light of a first wavelength. The light emitting diode (LED) module still further includes a second light emitting diode (LED) bank coupled to the second control output. The second LED bank includes at least one second light emitting diode (LED) for emitting light of a second wavelength multi-function illumination device further includes a mode-select switch coupled to the control circuit. The mode-select switch is adapted to allow a user to select a mode of operation of the light emitting diode (LED) module to selectively illuminate at least one of the first LED bank and the second LED bank. An illumination method includes during a first mode of operation: continuously providing illumination of a first wavelength, and flashing on and off illumination of a second wavelength at a predetermined flashing frequency.

The above summary of the invention is not intended to represent each embodiment or every aspect of the present invention.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF ILLUSTRATIVE EMBODIMENTS OF THE INVENTION

The present invention relates generally to flashlights and other portable, handheld, battery-operated illumination devices, and particularly to flashlights that use one or more light emitting diodes (LED) to generate the light beam.

Figure 1:
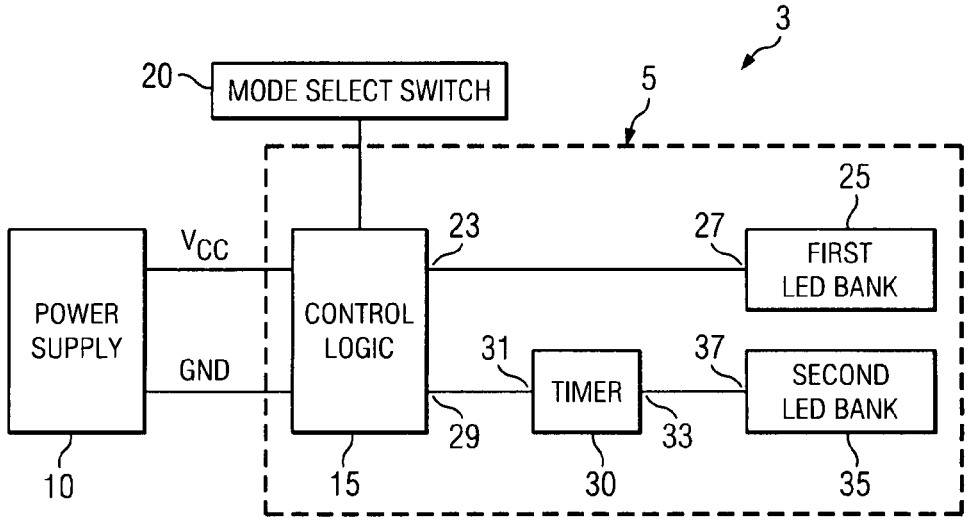
FIG. 1 is a block diagram of a multi-function LED illumination device.

Referring now to FIG. 1, a block diagram of a multi-function LED illumination device 3 in accordance with principles of the invention is illustrated. The multi-function LED illumination device 3 includes an LED module 5, a power supply 10, and a mode-select switch 20. The LED module 5 includes control logic 15, a timer circuit 30, a first LED bank 25, and a second LED bank 35. The first LED bank 25 includes at least one light emitting diode (LED) of a first wavelength. The second LED bank 35 includes at least one light emitting diode (LED) of a second wavelength. The power supply 10 provides a source of electrical power to the LED module 5 via a positive voltage connection Vcc and a ground connection GND. The control logic 15 has a first control output 23 connected to an input 27 of the first LED bank 25 to control illumination of the LEDs of the first LED bank 25. The control logic 15 has a second control output 29 connected to an input 31 of the timer circuit 30. An output 33 of the timer circuit 30 is connected to an input 37 of the second LED bank 35 to control illumination of the LEDs of the second LED bank 35.

The mode-select switch 20 allows for the selection of one of a plurality of operation modes for the multi-function LED illumination device 3. In at least one embodiment of the invention, the mode-select switch 20 is a push button in which consecutive pushes of the push button cause the LED illumination device 3 to cycle through a plurality of operation modes.

In a first operation mode, neither the first LED bank 25 nor the second LED bank 35 is illuminated. In a second operation mode, the first LED bank 25 is constantly illuminated and the second LED bank 35 is not illuminated. In a third operation mode, the first LED bank 25 is not illuminated, and the second LED bank 35 is constantly illuminated. In a fourth operation mode, the first LED bank 25 is constantly illuminated and illumination of the second LED bank 35 is periodically turned on and off (i.e., flashed and/or strobed) at a predetermined frequency. In at least one embodiment of the invention, the flashing frequency of the second LED bank 35 is in a range of ½ Hz to 1 Hz. In other embodiments, flashing frequencies of less than ½ Hz and greater than 1 Hz can be used.

In some embodiments of the multi-function LED illumination device 3 of FIG. 1, the first LED bank 25 includes at least one white LED and the second LED bank 35 includes at least one red LED. The multi-function LED illumination device 3 may function as a combination general purpose/night vision/blood tracker LED illumination device having, in addition to an OFF mode, three operating modes: 1) a general purpose white light mode in which the one or more white LEDs are continuously illuminated; 2) a red light mode for preserving night vision in which the one or more red LEDs are continuously illuminated; and 3) a blood-tracker mode, which uses a strobe or flashing red light mode for detecting and tracking blood or other red color substances. The blood-tracker mode is particularly useful, for example, when game hunters need to track an animal that has been wounded. In the blood tracker mode, the one or more white LEDs are constantly on and the one or more red LEDs are strobed on and off at a predetermined frequency.

Reflection of the pulsing red light off the blood or other red substance causes it to stand out against the white-light-illuminated background, making it more visible and noticeable to the user, especially at night. In addition, ground cover tends to absorb red wavelengths, while fresh blood will reflect it strongly, thus making the reflection of the blood or other red substance even more pronounced. Another exemplary use of the multi-function LED illumination device 3 of FIG. 1 is in crime-scene investigations to detect human blood drops and blood splatter in foliage. In still other embodiments of the multi-function LED illumination device 3 of FIG. 1, blue and/or green LEDs can be used instead of white LEDs to improve an observed contrast between the foliage and a red substance such as blood.

Figure 2:
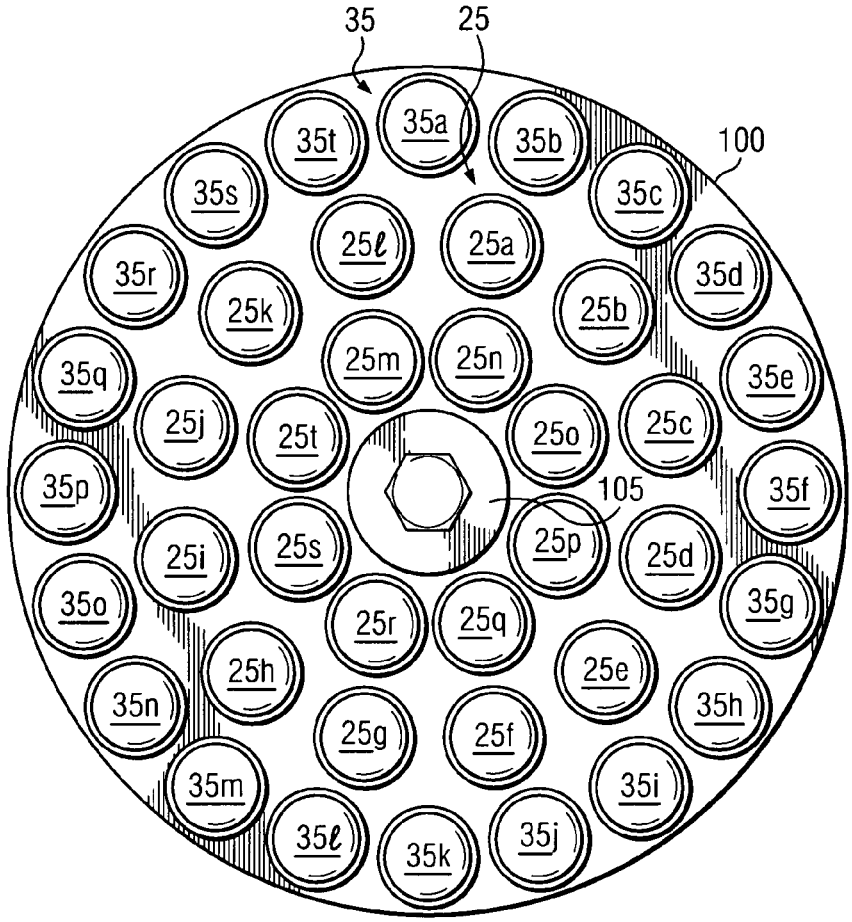
FIG. 2 is a front view of an LED module.

Referring now to FIG. 2, a front view of an embodiment of the LED module 5 of FIG. I is illustrated. The LED module 5 includes a first printed circuit board 100 having a bolt 105 passing therethrough. The first printed circuit board 100 of the LED module 5 further includes a first LED bank 25 including 20 white LEDs 25*a*-25*t* and a second LED bank 35 including 20 red LEDs 35*a*-35*t* mounted to a front surface thereof. Although white and red light beams have been described with respect to FIGS. 1 and 2, it should be understood that the invention is not limited to LEDs having red and white wavelengths or even only two wavelengths. Other or additional wavelength LEDs may be used without departing from principles of the invention.

In some embodiments, the LEDs 25*a*-25*t* and 35*a*-35*t* are solid-state, high-efficiency, high-brightness LEDs with well-matched wavelengths that have an operating lifetime of up to 10,000 hours, such as those available from, for example, Nichia Corporation of Tokyo, Japan or Cree, Inc. of Goleta, Calif. In some embodiments, light-beam angles from the white and red LEDs are approximately 15-20 degrees, but may be larger if needed.

Figure 3:
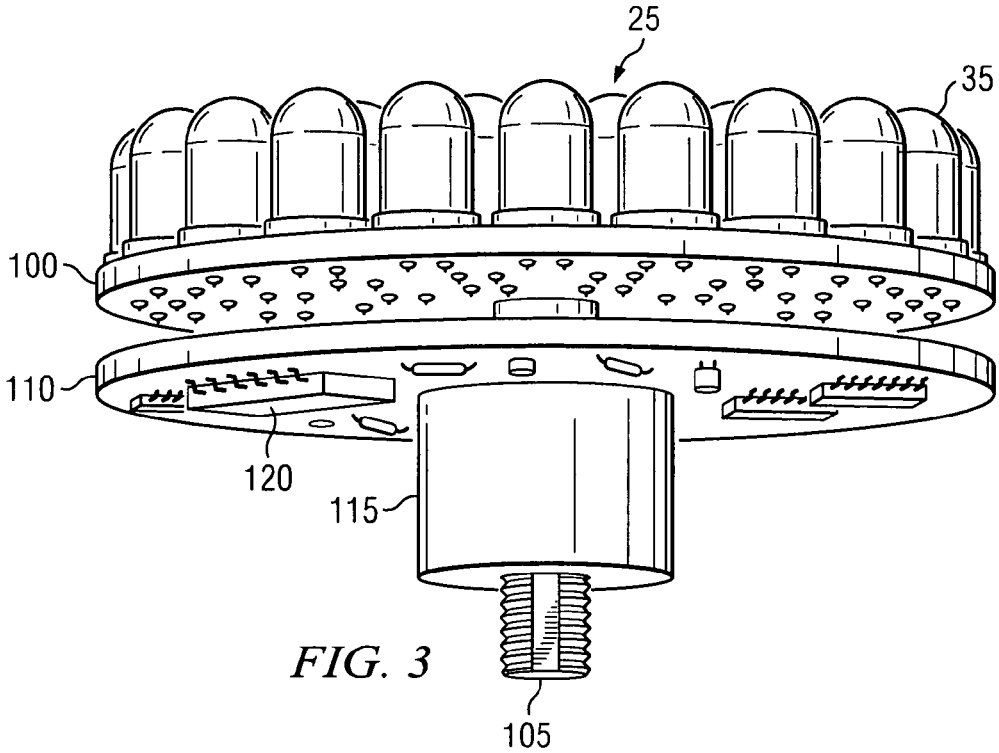
FIG. 3 is a side view of the LED module.
Figure 4:
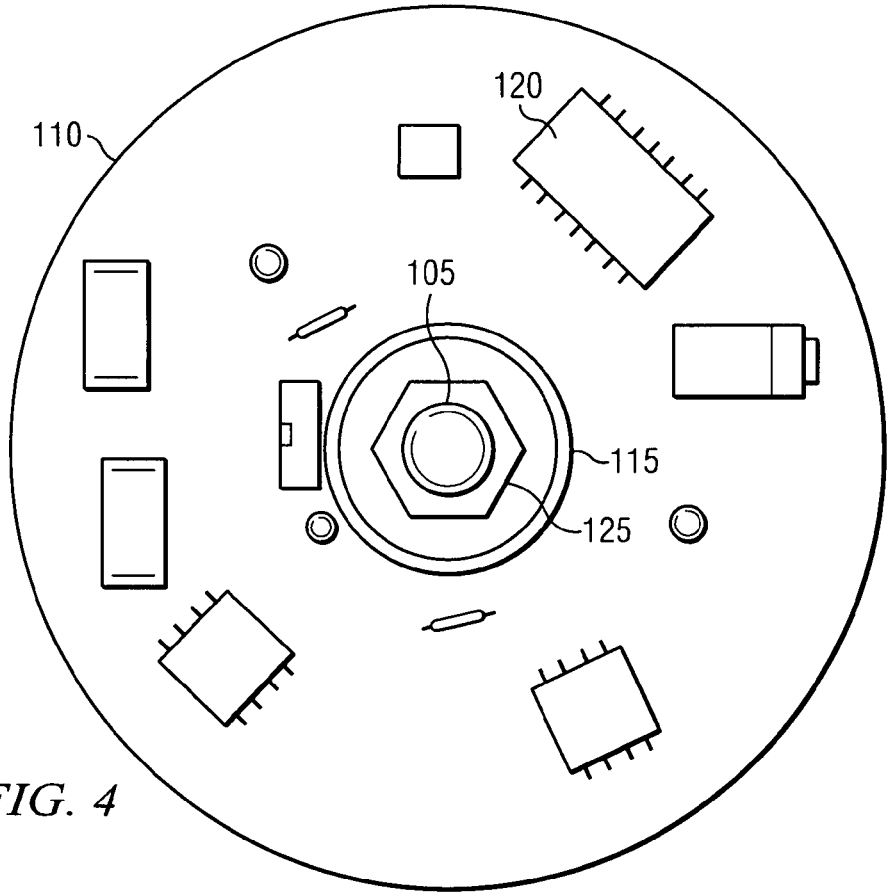
FIG. 4 is a rear view of the LED module.

Referring now to FIG. 3, a side view of the LED module 5 of FIG. 2 is illustrated. As can be seen in FIG. 3, the LED module 5 further includes a second printed circuit board 110 through which the bolt 105 also passes. Circuit components 120 which include the control logic 15 and the timer circuit 30, are mounted on a bottom surface of the second printed circuit board 110. The LED module 5 further includes a metal collar 115 affixed to a bottom surface of the second printed circuit board 110. The bolt 105 serves as a contact to provide the supply voltage Vcc to the LED module 5 from the power supply 10. The metal collar 115 acts as a contact to provide the ground connection GND to the LED module 5 from the power supply 10.

Figure 5:
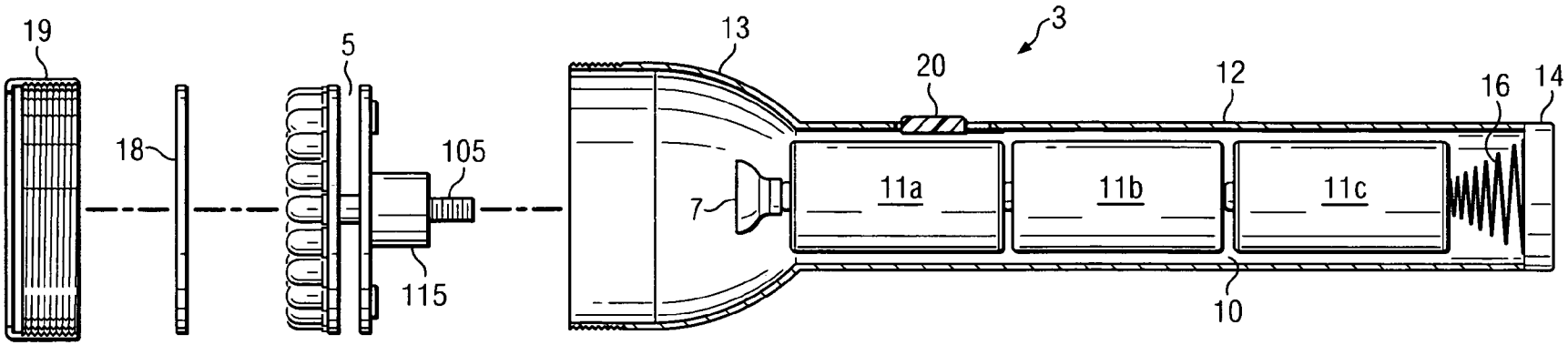
FIG. 5 is an exploded view of the multi-function LED illumination device of FIG. 1.

Still referring to FIG. 5, the LED module 5 is adapted to be contained within the front end 13 of the flashlight housing 12. A lens 18 is positioned in front of the LED module 5 and a front ring 19 is threadably coupled to the front end 13 of the flashlight housing 12. In a typical embodiment, the lens 18 may be, for example, a glass lens.

Referring now to FIG. 5, an exploded view of an embodiment of the multi-function LED illumination device 3 of FIG. 1 is illustrated. In various embodiments, the multi-function LED illumination device 3 is a flashlight, the flashlight being a handheld battery-powered illumination device. The multi-function LED illumination device 3 includes a flashlight housing 12 having the mode-select switch 20 attached thereto. The flashlight housing 12 further contains a power supply 10. In FIG. 5, the power supply 10 includes three batteries 11*a*-11*c*. In various embodiments, more than three or less than three batteries can be used. In still other embodiments, a rechargeable power supply can be used. In a front end 13 of the flashlight housing 12, a lamp holder 7 is mounted. The lamp holder 7 has a positive terminal in electrical contact with a positive terminal of the battery 11*a* when the mode-select switch 20 is closed. An end cap 14 is coupled to a rear end of the flashlight housing 12. The end cap 14 is in contact with a spring 16. The spring 16 provides an electrical connection between the negative terminal (or ground) of the battery 11*c* and the flashlight body 12. A negative terminal of the lamp holder 7 is electrically connected to the flashlight housing 12.

Still referring to FIG. 5, the LED module 5 is adapted to be contained within the front end 13 of the flashlight housing 12. A lens 18 is positioned in front of the LED module 5 and a front ring 19 is threadably coupled to the front end 13 of the flashlight housing 12.

Figure 6:
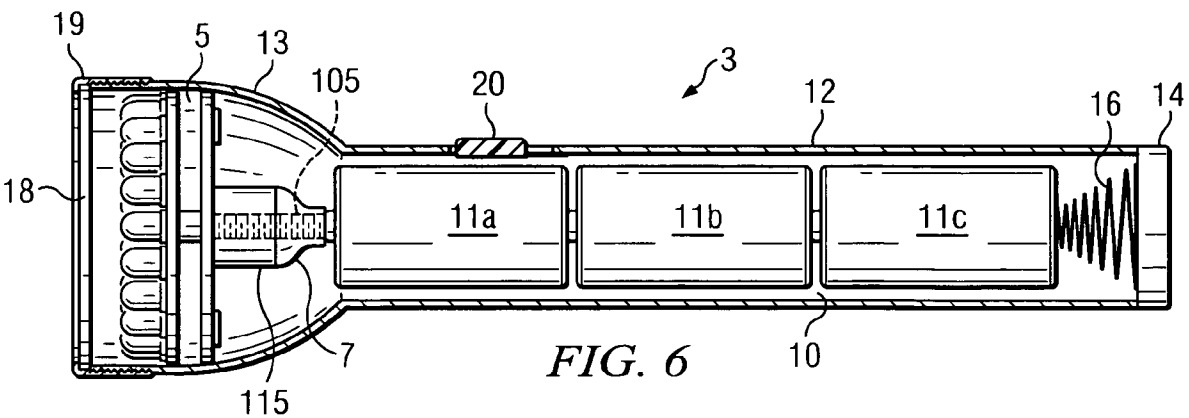
FIG. 6 is an assembled view of the multi-function LED illumination device of FIG. 5.

Referring now to FIG. 6, an assembled view of the multi-function LED illumination device of FIG. 5 is illustrated. As shown in FIG. 6, the LED module 5 is mounted within the front end 13 of the flashlight housing 12. The bolt 105 of the LED module 5 is threadably mounted and in electrical contact with the positive terminal of the lamp holder 7, and the metal collar is in electrical contact with the ground connection of the lamp holder 7.

While any suitable flashlight housing may be used for the LEDs, in the exemplary implementation of FIGS. 5-6, the multi-function LED illumination device 3 is retrofitted or otherwise adapted from a water-resistant housing of an existing flashlight. Such an adaptation results in an LED flashlight with a reliable threaded connection for the LED module 5, a lens 18, and provides battery life in excess of 12 hours when powered by the three batteries 11*a*-11*c* which may be, for example, standard D-cell batteries, depending on the operating mode used. The operating modes of the multi-function LED illumination device 3 may be selected by toggling the On/Off switch of the flashlight housing, which switch functions as the mode-select switch 20.

Figure 7:
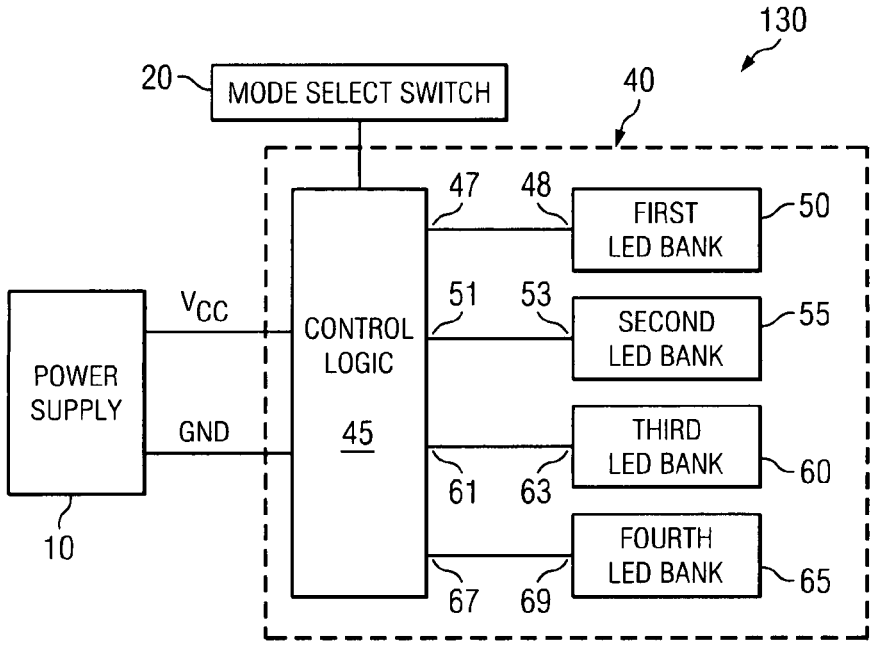
FIG. 7 is a block diagram of a multi-function LED illumination device.

Referring now to FIG. 7, a block diagram of a multi-function LED illumination device 130 is illustrated. The multi-function LED illumination device 130 includes an LED module 40, a power supply 10, and a mode-select switch 20. The LED module 40 includes control logic 45, a first LED bank 50, and a second LED bank 55, a third LED bank 60, and a fourth LED bank 65. The first LED bank 50 includes at least one light emitting diode (LED) of a first wavelength, the second LED bank 55 includes at least one LED of a second wavelength, the third LED bank 60 includes at least one LED of a third wavelength, and the fourth LED bank 65 includes at least one LED of a fourth wavelength. The power supply 10 provides a source of electrical power to the LED module 40 via a positive voltage connection Vcc and a ground connection GND. The control logic 45 has a first control output 47 connected to an input 49 of the first LED bank 50 to control illumination of the LEDs of the first LED bank 50, and a second control output 51 connected to an input 53 of the second LED bank 55 to control illumination of the LEDs of the second LED bank 55. The control logic 45 further has a third control output 61 connected to an input 63 of the third LED bank 60, and a fourth control output 67 connected to an input 69 of the fourth LED bank 65.

The mode-select switch 20 allows for the selection of one of a plurality of operation modes for the multi-function LED illumination device 130. In various embodiments of the invention, the mode-select switch 20 is a push button in which consecutive pushes of the pushbutton causes the multi-function LED illumination device 130 to cycle through the plurality of operation modes.

During a first operation mode (i.e., an OFF mode), none of the LEDs of the first LED bank 50, second LED bank 55, third LED bank 60, or fourth LED bank 65 are illuminated. During a second mode of operation, the LEDs of the first LED bank 50 are illuminated and the LEDs of the second LED bank 55, third LED bank 60, and fourth LED bank 65 are not illuminated. During a third mode of operation, the LEDs of the second LED bank 55 are illuminated and the LEDs of the first LED bank 50, third LED bank 60, and fourth LED bank 65 are not illuminated. During a fourth mode of operation, the LEDs of the third LED bank 60 are illuminated, and the LEDs of the first LED bank 50, the second LED bank 55, and fourth LED bank 65 are not illuminated. During a fifth mode of operation, the LEDs of the fourth LED bank 65 are illuminated, and the LEDs of the first LED bank 55, the second LED bank 55, and the third LED bank 60 are not illuminated. During a sixth mode of operation, the LEDs of the first LED bank 50 and the second LED bank 55 are not illuminated, and the LEDs of the third LED bank 60 and the fourth LED bank 65 are illuminated. During a seventh mode of operation, the LEDs of the first LED bank 50, the second LED bank 55, the third LED bank 60, and the fourth LED bank 65 are illuminated. It should be understood that additional operation modes may be added in which one or more of the LED banks are illuminated at the same time. In addition, although the embodiment of FIG. 7 is illustrated as having four LED banks, it should be understood that a multi-function illumination device having a different number of LED banks can be used in other embodiments.

In FIG. 7, the multi-function LED illumination device 130 provides illumination by multiple wavelength-selectable beams emitted by corresponding LEDs that may be selected by a user. The wavelength-selectable beams may be produced by LEDs that emit, for example, an infrared beam, an ultraviolet beam, a red beam, a white beam, a blue beam, a green beam, and the like. Each wavelength-selectable beam has one or more useful functions. The white beam, for example, provides a general-purpose light source, while the blue beam is useful for viewing fingerprints dusted with Redwop™ fingerprint powder or other bio-fluorescent substances. Blue light is also often used as an alternate light source (ALS) in crime scene investigations, while the ultraviolet beam is useful for viewing ultraviolet reactive agents (e.g., certain bodily fluids), document modifications, and the like. An illustrative wavelength range for blue light in accordance with an embodiment of the invention is 465-470 nm.

In various embodiments of the invention, a total of 40 LEDs are arranged on the LED module so that resulting beam angles are between 15 and 30 degrees depending on the particular LED vendors used. The LEDs may include a predetermined number of 380 nm wavelength (i.e., ultraviolet) LEDs, 465 nm wavelength (i.e., blue) LEDs, and white LEDs that have no specific wavelength, but are preferably of a high brightness.

Housing for the LEDs may be provided, for example, by retrofitting a housing from an existing flashlight or any other suitable housing as described with reference to FIGS. 5-6. A user may then toggle the mode-select switch 20 to activate the particular LEDs having the desired beam wavelength. In an exemplary embodiment, when powered by three standard D-cell batteries, battery life of 6-20 hours may be obtained depending on the operating mode used.

Where sufficiently powerful LEDs are employed, a single LED may be used for each white, blue, and ultraviolet beam wavelength. In another option, two or three such LEDs may be combined as needed (but typically fewer than in the 40-LED implementation) for a given beam wavelength. With more powerful LED chips, it is also possible to widen the beam angle to a flood of greater than 90 degrees. And since fewer LEDs are used for each beam than other embodiments having more LEDs, a more uniform illumination may be produced that may be preferred in some applications, such as, for example, at a crime scene, or for viewing specimens or evidence of forensic interest.

Figure 8:
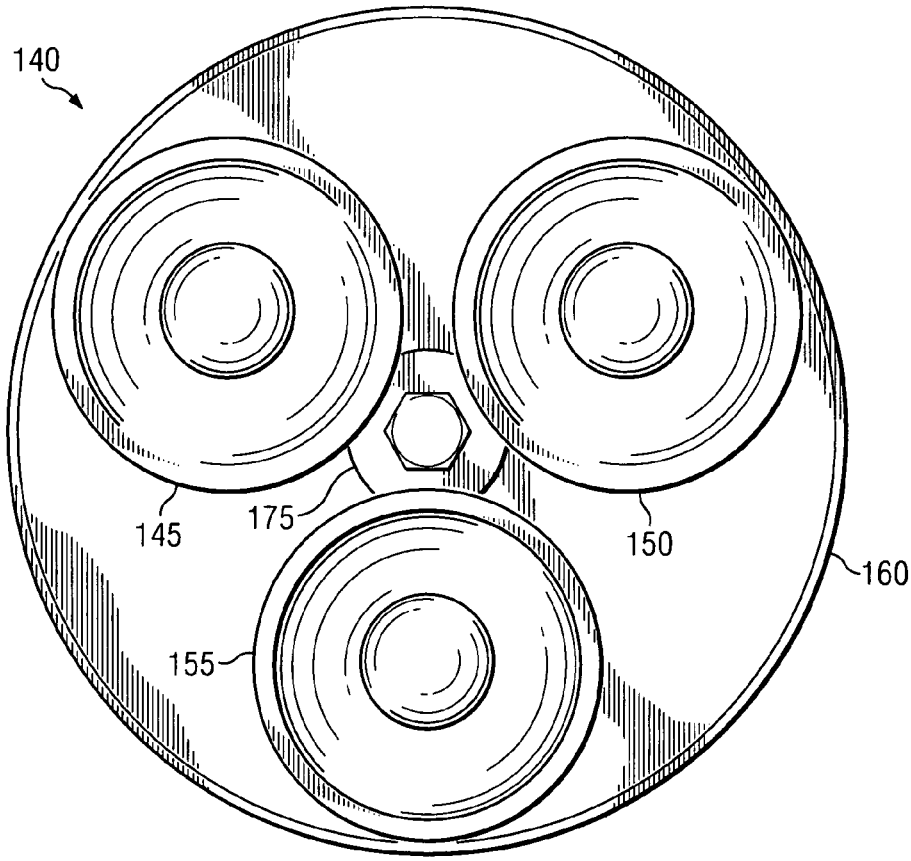
FIG. 8 is a front view of an LED module.

Referring now to FIG. 8, a front view of another embodiment of an LED module 140 is illustrated. The LED module 140 includes a first high flux emitter with secondary optics 145 for emitting light having a first wavelength, a second high flux emitter with secondary optics 150 for emitting light having a second wavelength, and a third high flux emitter with secondary optics 155 for emitting light having a third wavelength. The first high flux emitter with secondary optics 145, the second high flux emitter with secondary optics 150, and the third high flux emitter with secondary optics 155 are mounted on a first printed circuit board 160, through which a bolt 175 passes. In various embodiments of the invention, the first high flux emitter 145 emits white light, the second high flux emitter 150 emits light of a blue wavelength, and the third high flux emitter 155 emits light of an ultraviolet wavelength.

Figure 9:
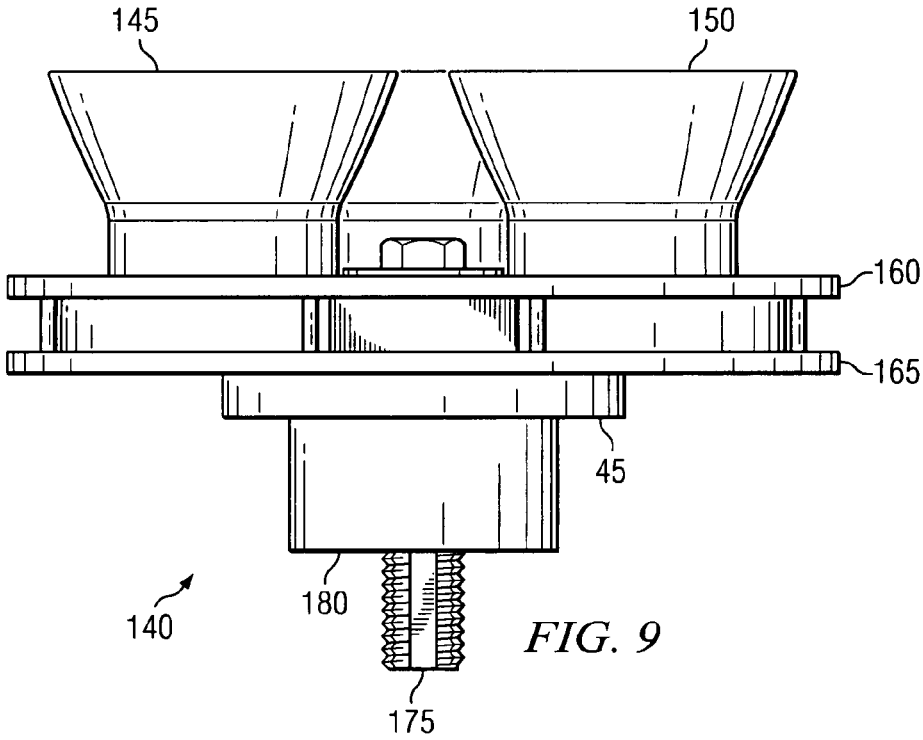
FIG. 9 is a side view of the LED module of FIG. 8.

Referring now to FIG. 9, a side view of the LED module 140 of FIG. 8 is illustrated. As can be seen in FIG. 9, the LED module 140 further includes a second printed circuit board 165 through which the bolt 175 also passes. Control logic 45 is mounted on a bottom surface of the second printed circuit board 165. The LED module 5 further includes a metal collar 180 affixed to the bottom surface of the second printed circuit board 165. The bolt 175 provides as a contact to provide the supply voltage Vcc to the LED module 140 from the power supply 10 and the metal collar 180 acts as a contact to provide a ground connection GND to the LED module 140 from the power supply 10.

Although white, blue, and ultraviolet light beams have been described with reference to FIG. 8, those having skill in the art with appreciate that the invention is not limited to these specific wavelengths. Alternative or additional wavelengths may certainly be used without departing from the scope of the invention. For example, in another implementation of the wavelength-selectable LED illumination device, LEDs having 395 nm and/or 380 nm and/or 365 nm may be added to the wavelength-selectable LED illumination device, thus giving the illumination device up to four selectable wavelengths. In illustrative applications, blue light of 465 nm wavelength may be used to excite fingerprint powder and ultraviolet light of 395 nm wavelength can be used to excite general UV reactive agents. Ultraviolet light of 380 nm wavelength may be used to excite evidence including semen, urine, fibers, etc. Ultraviolet light of 365 nm wavelength can be used to detect forensic bite marks, teeth, etc. In still another implementation, the 395 nm LEDs may be replaced with 405-410 nm LEDs that are closer to the Soret Band for hemoglobin detection. In other illustrative applications of the wavelength-selectable LED illumination device, green light of approximately 520 nm can be used.

In still other embodiments, a fifth or sixth selectable wavelength/mode or combination of wavelengths/modes may be added. For example, an "all on" mode may be used where all the LEDs are turned on (i.e., no specific wavelength is selected), and/or a mode may be used where one or more predefined sub-groups of LEDs may be turned on to achieve varying degrees of intensity/brightness. All of these wavelengths/modes may be selectable by the user by toggling the mode select switch 20. In some embodiments of the invention, the mode select switch 20 is an on/off switch of a flashlight housing or other suitable housing.

While the above embodiments have been described with reference to flashlights, it should be understood that the principles described herein can be applied to other illumination devices such as an LED lantern.

Figure 10:
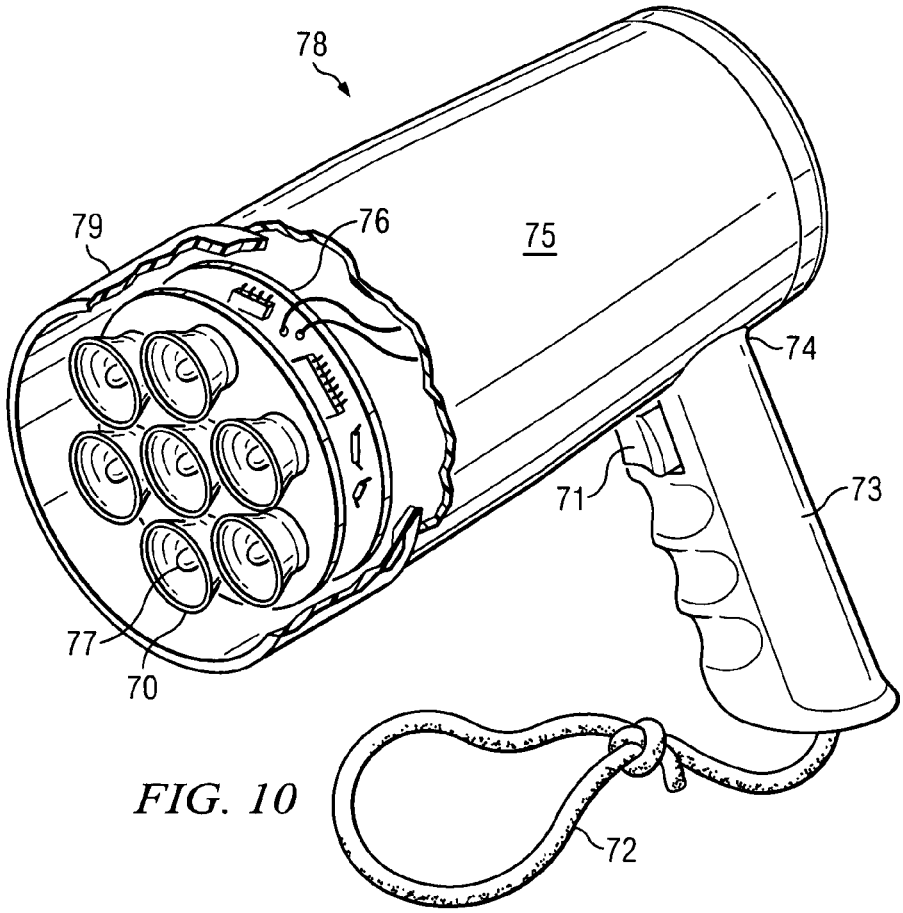
FIG. 10 is an assembled view of another embodiment of a multi-function LED device.

Referring now to FIG. 10, an assembled view of another embodiment of a multi-function LED illumination device 78 is illustrated. In the embodiment illustrated in FIG. 10, the multi-function LED illumination device 78 is an LED lantern. The multi-function LED illumination device 78 includes a lantern body 75 having an attached pistol grip 73. In other embodiments of the multi-function LED illumination device 78, the pistol grip 73 can be formed as part of the lantern body 75. The pistol grip can further have a wrist strap 72 attached thereto. The multi-function LED illumination device 78 further includes a trigger switch 71 attached to the pistol grip 73. In various embodiments, the trigger switch 71 functions in the same way as or similar to the mode-select switch 20 as described with respect to FIGS. 1 and 7.

A plurality of high flux LED emitters 77 with secondary optics 70 are mounted in a front portion 79 of the lantern body 75. In various embodiments, the plurality of high flux LED emitters 77 with secondary optics 70 function in the same way as or similar to the first LED bank 25 and second LED bank 35 as described with respect to FIG. 1. In still other embodiments, the plurality of high flux LED emitters 77 with secondary optics 70 function in the same way as or similar to one or more of the first LED bank 50, the second LED bank 55, the third LED bank 60, and the fourth LED bank 65 as described with respect to FIG. 7. The lantern body 75 further includes control logic 76 mounted therein. In various embodiments, the control logic 76 functions in the same way as or similar to the control logic 15 and timer circuit 30 as described with respect to FIG. 1. In various other embodiments, the control logic 76 functions in the same way as or similar to the control logic 45 as described with respect to FIG. 7.

The lantern body 75 further includes a power supply (not shown) housed therein to provide power to the control logic 76. In accordance with various embodiments, the power supply is at least one rechargeable battery. In such embodiments, the multi-function LED illumination device 78 can include a rear power port 74 for recharging the power supply.

In various embodiments, the multi-function LED illumination device 78 functions in the same way as or similar to the multi-function LED illumination device 3 of FIG. 1. In various other embodiments, the multi-function LED illumination device 78 functions in the same way as or similar to the multi-function LED illumination device 130 of FIG. 7.

Figure 11:
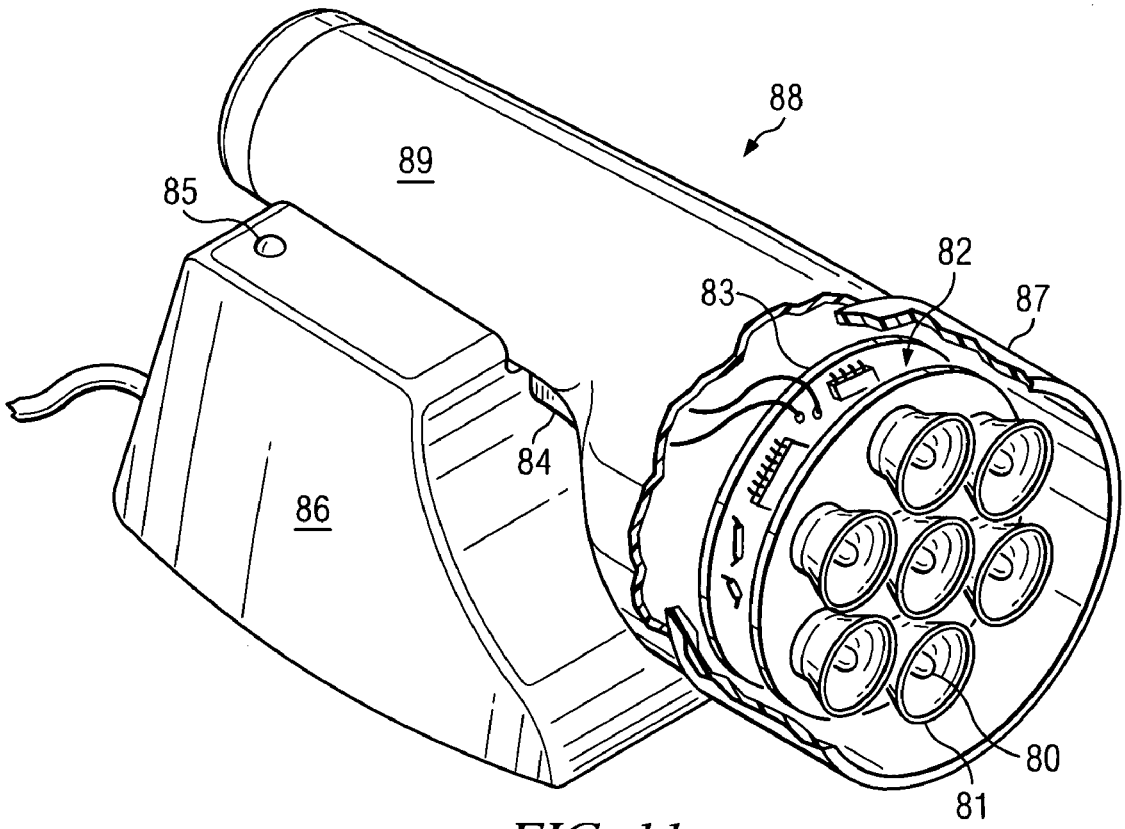
FIG. 11 is an assembled view of still another embodiment of a multi-function LED illumination device.

Referring now to FIG. 11, an assembled view of another embodiment of a multi-function LED illumination device 88 is illustrated. In the embodiment illustrated in FIG. 11, the multi-function LED illumination device 88 is an LED lantern. The multi-function LED illumination device 88 includes a housing 86 having an grip 89. In other embodiments of the multi-function LED illumination device 88, the grip 89 can be formed as part of the housing 86. The multi-function LED illumination device 88 further includes a trigger switch 84 attached to the grip 89. In various embodiments, the trigger switch 84 functions in the same way as or similar to the mode-select switch 20 as described with respect to FIGS. 1 and 7.

A plurality of high flux LED emitters 80 with secondary optics 81 are mounted to an emitter board 82 in a front portion 87 of the housing 86. In various embodiments, the plurality of high flux LED emitters 80 with secondary optics 81 function in the same way as or similar to the first LED bank 25 and second LED bank 35 as described with respect to FIG. 1. In still other embodiments, the plurality of high flux LED emitters 80 with secondary optics 81 function in the same way as or similar to one or more of the first LED bank 50, the second LED bank 55, the third LED bank 60, and the fourth LED bank 65 as described with respect to FIG. 7. The front portion 87 of the housing 86 further includes control logic 83 mounted therein. In various embodiments, the control logic 83 functions in the same way as or similar to the control logic 15 and timer circuit 30 as described with respect to FIG. 1. In various other embodiments, the control logic 83 functions in the same way as or similar to the control logic 45 as described with respect to FIG. 7.

The housing 86 further includes a power supply (not shown) housed therein to provide power to the control logic 83. In accordance with various embodiments, the power supply is at least one rechargeable battery. In such embodiments, the multi-function LED illumination device 88 can include a power port 85 for recharging the power supply.

In various embodiments, the multi-function LED illumination device 88 functions in the same way as or similar to the multi-function LED illumination device 3 of FIG. 1. In various other embodiments, the multi-function LED illumination device 88 functions in the same way as or similar to the multi-function LED illumination device 130 of FIG. 7.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A multi-function illumination device comprising:

a light emitting diode (LED) module including:

a control circuit having a first control output and a second control output;

a first LED bank coupled to the first control output, the first LED bank comprising at least one LED for emitting light of a first wavelength, wherein said light of said first wavelength is selected from the group consisting of blue light, green light, and combinations thereof;

a second LED bank coupled to the second control output, the second LED bank comprising at least one LED for emitting red light of a second wavelength;

the control circuit causing, in a first mode of operation, the first LED bank to illuminate continuously and the second LED bank to flash on and off at a predetermined frequency such that the red flashing light emitted from the second LED bank causes a red substance to stand out against the continuously illuminated light of said first wavelength emitted from the first LED bank making the red substance more visible to a user for functioning as a blood tracker illumination device.

2. The multi-function illumination device of claim 1, wherein the first wavelength is different from the second wavelength.

3. The multi-function illumination device of claim 1, wherein during a second mode of operation, the control circuit is adapted to cause the first LED bank to illuminate continuously and the second LED bank to not illuminate.

4. The multi-function illumination device of claim 1, wherein, during a third mode of operation, the control circuit is adapted to cause the first LED bank to not illuminate and the second LED bank to illuminate continuously.

5. A multi-function illumination device comprising:

a light emitting diode (LED) module including:

a control circuit having a first control output and a second control output;

a first LED bank coupled to the first control output, the first LED bank comprising at least one LED for emitting white light of a first wavelength;

a second LED bank coupled to the second control output, the second LED bank comprising at least one LED for emitting red light of a second wavelength;

the control circuit causing, in a first mode of operation, the first LED bank to illuminate continuously and the second LED bank to flash on and off at a predetermined frequency such that the red flashing light emitted from the second LED bank causes a red substance to stand out against the continuously illuminated white light emitted from the first LED bank making the red substance more visible to a user for functioning as a blood tracker illumination device; and wherein the multi-function illumination device comprises at least one of a flashlight and a lantern.

6. The multi-function illumination device of claim 5, wherein the first wavelength is different from the second wavelength.

7. The multi-function illumination device of claim 5, wherein during a second mode of operation, the control circuit is adapted to cause the first LED bank to illuminate continuously and the second LED bank to not illuminate.

8. The multi-function illumination device of claim 5, wherein, during a third mode of operation, the control circuit is adapted to cause the first LED bank to not illuminate and the second LED bank to illuminate continuously.

9. The multi-function illumination device of claim 5, further comprising a mode-select switch coupled to the control circuit, the mode-select switch being adapted to allow a user to select a mode of operation of the light emitting diode (LED) module.

10. The multi-function illumination device of claim 5, further comprising a housing adapted to contain the LED module.

11. The multi-function illumination device of claim 5, wherein the at least one first LED comprises a plurality of light emitting diodes.

12. The multi-function illumination device of claim 5, wherein the at least one second LED comprises a plurality of light emitting diodes.

13. The multi-function illumination device of claim 5, further comprising a mode-select switch coupled to the control circuit, the mode-select switch being adapted to allow a user to select a mode of operation of the light emitting diode (LED) module.

14. The multi-function illumination device of claim 5, further comprising a housing adapted to contain the LED module.

15. The multi-function illumination device of claim 5, wherein the at least one first LED comprises a plurality of light emitting diodes.

16. The multi-function illumination device of claim 5, wherein the at least one second LED comprises a plurality of light emitting diodes.

17. The multi-function illumination device-of claim 5, further comprising a power supply adapted to supply electrical power to the control circuit.

18. The multi-function illumination device of claim 17, wherein the LED module further comprises a metal collar adapted to provide a ground connection to the LED module from the power supply.

19. The multi-function illumination device of claim 17, wherein the LED module further comprises a bolt adapted to provide a supply voltage to the LED module from the power supply.

20. The multi-function illumination device of claim 19, further comprising a lamp holder adapted to be threadably coupled with the bolt.

21. The multi-function illumination device-of claim 5, further comprising a power supply adapted to supply electrical power to the control circuit.

22. The multi-function illumination device of claim 21, wherein the LED module further comprises a metal collar adapted to provide a ground connection to the LED module from the power supply.

23. The multi-function illumination device of claim 21, wherein the LED module further comprises a bolt adapted to provide a supply voltage to the LED module from the power supply.

24. The multi-function illumination device of claim 23, further comprising a lamp holder adapted to be threadably coupled with the bolt.

25. A method of tracking blood utilizing a multi-function illumination device comprising:

providing an LED module having a plurality operational modes, the LED module comprising:

a control circuit having a first control output and a second control output;

a first LED bank coupled to the first control output, the first LED bank comprising at least one LED for emitting white light;

a second LED bank coupled to the second control output, the second LED bank comprising at least one LED for emitting red light;

selecting a first mode of operation from the plurality of operational modes, the first mode of operation being operable to cause the first LED bank to illuminate continuously and the second LED bank to flash on and off at a predetermined frequency; and the red flashing light emitted from the second LED bank is operable to cause a red substance to stand out against the continuously illuminated white light emitted from the first LED bank making the red substance more visible to a user.

26. The method of claim 25, wherein the step of selecting is performed via a mode-select switch coupled to the control circuit.

27. The method of claim 25, wherein the LED module comprises a bolt adapted to provide a supply voltage to the LED module from a power supply.

28. The method of claim 25, wherein the at least one first LED comprises a plurality of light emitting diodes.

29. The method of claim 25, wherein the at least one second LED comprises a plurality of light emitting diodes.

* * * * *